US006100819A

United States Patent [19]

White

[11] Patent Number: 6,100,819

[45] Date of Patent: Aug. 8, 2000

[54] VEHICULAR TRAFFIC SIGNALIZATION METHOD AND APPARATUS FOR AUTOMATICALLY DOCUMENTING TRAFFIC LIGHT VIOLATIONS AND PROTECTING NON-VIOLATING DRIVERS

[75] Inventor: Mark White, 4308 N. Ash, Spokane, Wash. 99205

[73] Assignee: Mark White, Spokane, Wash.

[21] Appl. No.: 09/374,083

[22] Filed: Aug. 12, 1999

[51] Int. Cl.[7] ..... G08G 1/01

[52] U.S. Cl. ..... 340/933; 340/902; 340/906; 340/907; 340/908; 340/930; 340/933; 364/436; 364/438; 364/424; 364/565

[58] Field of Search ..... 340/902, 906, 340/907, 908, 930, 933, 937; 364/436, 438, 424, 565

[56] References Cited

U.S. PATENT DOCUMENTS

| | | | |
|---|---|---|---|
| 5,381,155 | 1/1995 | Gerber | 342/104 |
| 5,938,717 | 4/1996 | Dunne et al. | 701/117 |
| 5,955,968 | 1/1997 | Bentrott et al. | 340/906 |
| 5,986,575 | 7/1997 | Jone et al. | 340/906 |

*Primary Examiner*—Jeffery A. Hofsass
*Assistant Examiner*—Hung Nguyen
*Attorney, Agent, or Firm*—Tina Kagi

[57] ABSTRACT

The subject invention relates to methods and apparatus for monitoring and regulating the flow of traffic through intersections and specifically to an improved method and apparatus for automatically detecting and documenting disregard of traffic signals for purposes of prosecuting offenders and reducing the risk posed to the driving public posed by disregard of traffic signals without the need for police presence. The present invention comprises traffic signalization lights at adjacent street intersections; a traffic detection and speed measurement means; a traffic light state sensor means; and a traffic light delay means designed to coordinate the traffic detection and speed measurement means and timing of the traffic signalization lights and a recording means to document the license plate number of violating vehicles. The system is designed to automatically detect and document disregard of traffic signals for purposes of creating evidence crucial for prosecuting traffic light violations and reducing the risk posed to innocent drivers by delaying the change to green of adjacent traffic signals when the system detects that a traffic signal has not been obeyed. A simple means for recording the date, time, and place of the violation can be easily incorporated as well.

4 Claims, 1 Drawing Sheet

VEHICULAR TRAFFIC SIGNALIZATION METHOD AND APPARATUS FOR AUTOMATICALLY DOCUMENTING TRAFFIC LIGHT VIOLATIONS AND PROTECTING NON-VIOLATING DRIVERS

BACKGROUND

A. Field of Invention

The Insurance Institute for Highway Safety claims that, in 1996, of the 41,907 people killed on America's roadways, 809 deaths were caused by red traffic light-runners. The subject invention relates to methods and apparatus for monitoring, regulating and documenting the flow of traffic through intersections and specifically to an improved method and apparatus for automatically documenting disregard of traffic signals and reducing the associated risk posed to the driving public without the actual need for police presence.

The present invention proposes a unique and simple method for automatically monitoring and regulating the flow of traffic through street intersections which will document disregard of traffic signals for purposes of creating evidence crucial for prosecuting offenders. The invention also serves to reduce the associated risk posed to innocent drivers by delaying the change to green of adjacent traffic signals when the system detects disregard of a traffic signal.

The collateral effects of the present invention include higher conviction rates for those who disobey traffic signals, increased income to municipalities employing the invention from collection of fines imposed, and increased public safety resulting from a reduction of accidents related to disregard of traffic signals.

The present invention is efficient, safe, cost-effective, and easily retrofitted to existing traffic signals, while reducing the problems associated with drivers who choose to ignore traditional traffic signals.

The subject invention will not only serve to protect innocent drivers from those operators who wilfully violate traffic signals, but further serve to protect the public from police or emergency vehicles involved in high-speed pursuits or emergency response calls which frequently require disobedience of traffic signals for reasons of public necessity.

B. Discussion of Prior Art

1. Overview of Conventional Traffic Signal Operation. Methods and apparatus for regulating the flow of traffic through intersections are well known in the prior art. The traditional electric green, yellow, and red light fixtures, usually triggered by sensors responsive to automobile weight embedded in the pavement in front of the traffic light and/or regulated by timers, can be seen hanging above intersections in most every city and town in America.

Some examples of traffic light signals disclosed in the prior art include: U.S. Pat. No. 4,684,919, Hihi (1987), (utilizing LED illumination); U.S. Pat. No. 4,924,612, Kopelman, (1990), (utilizing fiber optics technology); as well as U.S. Pat. No. 5,010,319, Killinger, (1991), U.S. Pat. No. 5,111,183, Wang, (1992); and U.S. Pat. No. 5,278,5554, Marton, (1994).

C. Present Status of the Art and Evaluation of Prior Patents

Heretofore, systems have been disclosed in the prior art which incorporate the "basic" traffic light, in its many variations, into a regulatory, monitoring, and/or recording systems.

One example of the prior art in this area regulates traffic lights within a relatively wide district in order to synchronize traffic lights and coordinate the same in accordance with the actual traffic conditions in subdistricts in order to achieve smooth traffic flows within the wide district ("Traffic Signal Control System," U.S. Pat. No. 3,652,983, Endo et al., (Mar. 8, 1972). While said invention addresses the inconvenience and possible safety issues associated with inconsistent traffic flow, the Endo system is not designed to address those problems specifically associated with drivers who disregard traffic signals.

A "Device for Monitoring Traffic Violating and for Recording Traffic Statistics," is disclosed by U.S. Pat. No. 5,041,828, Loeven, (Aug. 20, 1991), and comprises a traffic monitoring device with a sensor responding to passing vehicles. From a signal evaluation, the system determines whether a detected vehicle has exceeded the maximum speed limit allowed. When such a violation takes place, a camera is automatically released and the monitored vehicle is photographed for purposes of substantiating the identity of the violating vehicle. A memory function records events detected by the device for statistical purposes. The Loeven invention addresses the problem of excessive vehicle speed but does not attack the dangers associated with drivers who run red traffic lights.

A "Traffic Safety Monitoring Apparatus" is disclosed at U.S. Pat. No. 5,0669,950, Schweitzer, et al., (Nov. 19, 1991), comprising an apparatus for establishing a pair of precisely spaced radiation beams in association with a thoroughfare, whereby passage of a vehicle along the thoroughfare interrupts the radiation beams and providing output indications of vehicle speed and space between adjacent moving vehicles. The apparatus includes a feature for photography of vehicles fulfilling predetermined criteria such as excessive speed. Again, the disclose of Schweitzer, et al., reveals an apparatus primarily designed to address the problem of "speeding" and not specifically the risk associated with drivers who ignore traffic lights.

A "Method for Identifying Objects in Motion, in Particular Vehicles and Systems for its Implementation," is disclosed by Deffontaines, U.S. Pat. No. 5,083,200 (Jan. 21, 1992), where a silhouette image of a passing vehicle, within a predetermined identification zone following a predetermined movement axis, is produced. This device is primarily designed for use by those requiring vehicle identification, such as toll booths in the case of documenting "drive-offs," and is not designed to protect the driving public from those who "run" red traffic lights.

Most relevant to the present invention is a device for cracking down on disregard of traffic signals as disclosed by Toyama, U.S. Pat. No. 5,432,547, (July 11, 1995). This device comprises a television camera for imaging a road, on which traffic signal lights are mounted at a cross; a vehicle movement measuring instrument for processing image data from the television camera in order to measure vehicle traveling position and speed; a signal state detector for detecting an indication of signal light color and a traffic signal disregarding vehicle detector for detecting a vehicle which has disregarded a traffic signal based on the traveling position and the traveling speed of the vehicle measured by the vehicle movement measuring system and the color of the traffic light as detected by the of the signal state detector. The vehicle movement measuring instrument measures the distance from the cross and the speed of the vehicle. In the case where there is a vehicle traveling within the cross, while the signal state detector detects a red indication of the signal lights, it is detected as a vehicle which has disregarded the traffic signal and a recorder records the traveling state and the registration number thereof.

The subject invention is an improvement over the Toyama apparatus primarily due to the fact that: (1) expensive television equipment providing continuous recording is not required for implementation of the White apparatus; (2) measurement of vehicle speed based upon recorded video images as employed by Toyama is not highly accurate; (3) the Toyama device halts traffic at subsequent traffic lights and transmits an alert to law enforcement authorities upon each traffic light violation, whereas, the White conception seeks to reduce costly involvement by police authorities, freeing up these important services for other and more urgent public needs; and (4) the Toyama invention does not serve to protect drivers at adjacent intersections from drivers violating traffic signals.

D. Objects and Advantages

The present invention is designed to reduce the danger to drivers at adjacent intersections posed by drivers who disregard traffic signals and to address the problems related to prosecuting and convicting offenders absent the constant presence of law enforcement.

Accordingly, besides the objects and advantages of the improved method and apparatus for traffic signalization described above, several objects and advantages of the present invention are:

(a) to provide an improved method and apparatus of automatically monitoring, regulating and recording disregard of traffic signals that is safe, effective, accurate, and reliable;

(b) to provide a durable, low-maintenance improved method and apparatus for automatically monitoring, regulating and recording disregard of traffic signals;

(c) to provide an improved method and apparatus for automatically monitoring, regulating and recording disregard of traffic signals capable of being easily adapted for use or "retro-fitted" to existing traffic signalization devices;

(d) to provide an improved method and apparatus for automatically monitoring, regulating and recording disregard of traffic signals that is inexpensive to operate and maintain;

(e) to provide an improved method and apparatus for automatically monitoring, regulating and recording disregard of traffic signals which increases traffic light violation conviction rates and also income to municipalities from collection of associated fines;

(f) to provide an improved method and apparatus of traffic signalization that reduces fatality rates associated with drivers who run red lights;

(g) to provide an improved method and apparatus for automatically monitoring, regulating and recording disregard of traffic signals that is inexpensive to manufacture, install, operate, and maintain, particularly vis-a-vis potential income from increased collection of fines (without the need for increased police presence), and therefore cost-effective and affordable for purchase and use by small, as well as large, municipalities;

(h) to provide an improved method and apparatus for automatically monitoring, regulating and recording disregard of traffic signals that reduces the need for the actual presence or involvement of law enforcement.

(i) Further objects and advantages are to provide an improved method and apparatus for automatically monitoring, regulating and recording disregard of traffic signals that is simple to use and easily repaired.

Additional objects and advantages of this invention will become apparent from a consideration of the drawings and ensuing description.

Figure 1:
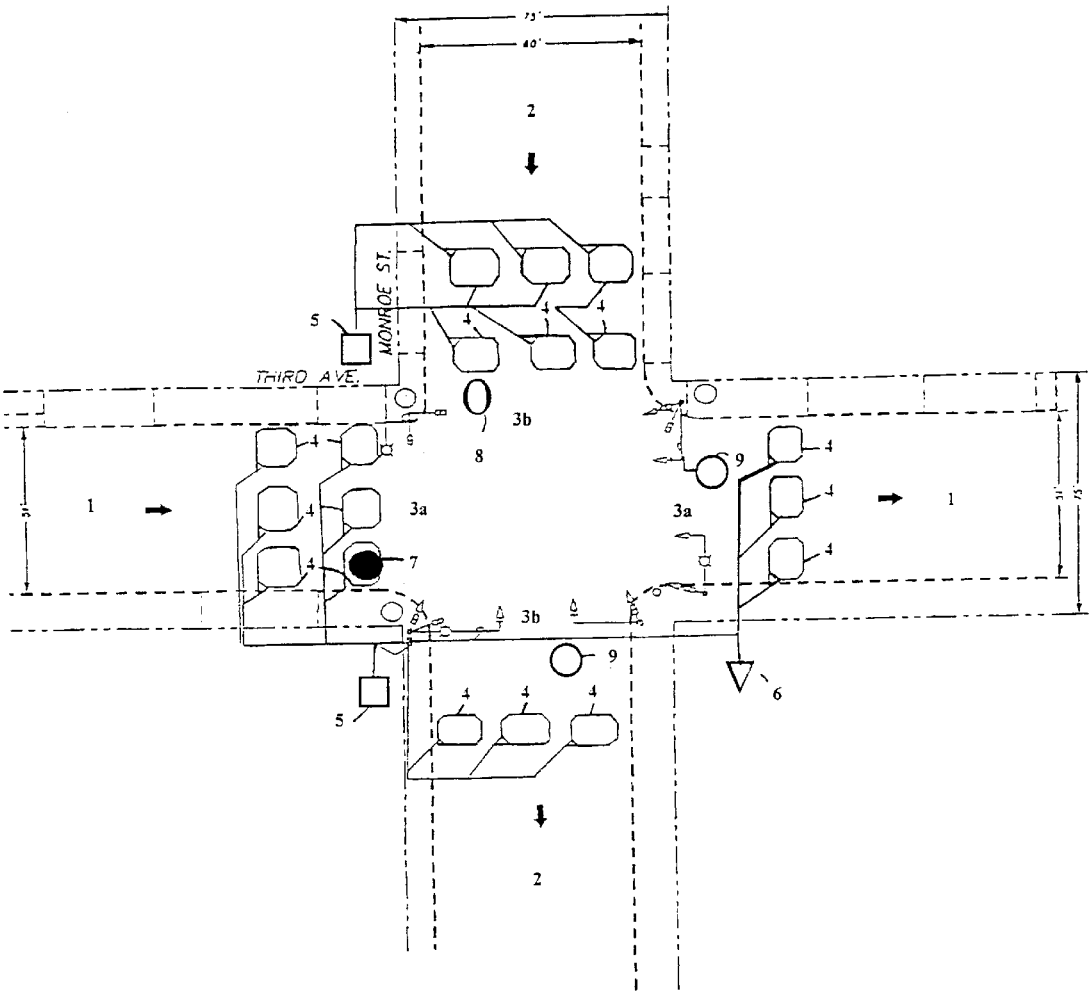
FIG. 1 shows a diagram of the preferred embodiment.

The FIG. 1 diagram of the subject invention depicts the following features identified numerically: (1) street labeled "Third Ave." (2) intersecting street labeled "Monroe St." (NOTE that both streets are one-way in the direction indicated by the arrows); set (3)*a* and set (3)*b* traffic signalization lights with (3)*a* governing governing Third Ave. traffic and (3)*b* governing Monroe Street traffic; (4) a traffic detection and speed measurement means, (5) a traffic light state sensor means; (6) a traffic light delay means designed to coordinate the traffic detection and speed measurement means and timing of the two traffic signalization lights. Two different vehicles, one at each intersecting street, are depicted by a solid oval (7) on Third Ave., and a clear oval (8) on Monroe Street.

SUMMARY OF THE INVENTION

There has thus been outlined rather broadly the more important features of this invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components as set forth in the following description or as illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based, may readily be utilized as a basis for designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract if to enable the U.S. Patent and Trademark Office, the public generally, and especially the scientists, engineers, and practitioners in the art who are not familiar with patent or legal terms and phraseology to determine quickly from a cursory inspection, the nature and essence of the technical disclosure of the application. The abstract is neither intended to define the invention of the application, which is measured by the claims, nor is it intended to be limiting as to the scope of the invention in any way.

Therefore, the objects of the present invention are.

(a) to provide an improved method and apparatus for automatically documenting traffic light violations and protecting non-violating drivers;

(b) to provide an improved method and apparatus of automatically monitoring, regulating and recording disregard of traffic signals that is safe, effective, accurate, and reliable;

(c) to provide a durable, low-maintenance method and apparatus for automatically monitoring, regulating and recording disregard of traffic signals, (d) to provide an improved method and apparatus for automatically monitoring, regulating and recording disregard of traffic signals capable of being easily adapted for use or "retro-fitted" to existing traffic signalization devices;

(e) to provide an improved method and apparatus for automatically monitoring, regulating and recording disregard of traffic signals that is inexpensive to operate and maintain;

(f) to provide an improved method and apparatus for automatically monitoring, regulating and recording disregard of traffic signals which increases traffic light violation conviction rates and also income to municipalities from collection of associated fines;

(g) to provide an improved method and apparatus of traffic signalization that reduces fatality rates associated with drivers who run red lights;

(h) to provide an improved method and apparatus for automatically monitoring, regulating and recording disregard of traffic signals that is inexpensive to manufacture, install, operate, and maintain, particularly vis-a-vis potential income from increased collection of fines (without the need for increased police presence), and therefore cost-effective and affordable for purchase and use by small, as well as large, municipalities;

(i) to provide an improved method and apparatus for automatically monitoring, regulating and recording disregard of traffic signals that reduces the need for the actual presence or involvement of law enforcement. (i) Further objects and advantages are to provide an improved method and apparatus for automatically monitoring, regulating and recording disregard of traffic signals that is simple to use and easily repaired.

These, together with other objects of the invention, along with the various features of novelty which characterize the invention, are specified in the claims annexed to and forming part of this disclosure. For a better understanding of the invention, its advantages and the specific objects attained by its uses, reference should be made to the accompanying drawings and descriptive matter in which there are illustrated preferred embodiments of the invention.

V. NARRATIVE DESCRIPTION

The FIG. 1 diagram of the preferred embodiment of the subject invention discloses use of a "PEEK Traffic" basic electromagnetic inductive loop detection and speed measurement system for purposes of traffic detection and speed measurement; however, virtually any previously conceived means of traffic detection and speed measurement would be adequate for incorporation into the present invention, including but not limited to that commonly utilized in automatic traffic data collection devices such as standard road air tube switches, piezo, infrared, photo radar or laser sensors.

The preferred embodiment of the subject invention comprises: traffic signalization lights at adjacent street intersections; a traffic detection and speed measurement means, a traffic light state sensor means; and a traffic light delay means designed to coordinate the traffic detection and speed measurement means and timing of the traffic signalization lights.

Another embodiment of the invention incorporates an excessive speed detection and recording means which documents the license plate numbers of violating drivers when the traffic detection and speed measurement means registers a vehicle running a red light in excess of the maximum posted speed. A simple means for simultaneously recording the date, time, and place of the violation can be easily incorporated as well.

VI. OPERATION.

A. Operation Summary

A traffic detection and speed measurement means (4) registers the presence and velocity of a vehicle (8) moving through a traffic signal (3)*b* after a traffic light state sensor means (5) registers the existence of a red light (3)*b*. If the vehicle (8) stops before entering the intersection, nothing happens. If, however, the traffic detection and speed measurement means (4) senses the vehicle (8) has or will run the red light (3)*b*, a traffic light delay means (6) in data communication with the traffic detection and speed measurement means (4), the first traffic signal (3)*a*, and second traffic signal (3)*b* will delay the transition to green of the traffic signal (3)*a* regulating the intersecting street until the traffic detection and speed measurement means (4) indicates that the violating vehicle (8) has safely cleared the intersection.

Another embodiment of the invention incorporates an excessive speed detection and recording means (9) which documents the license plate numbers of violating drivers when the traffic detection and speed measurement means (4) registers a vehicle running a red light in excess of the maximum posted speed.

The subject "Improved Vehicular Traffic Signalization Method and Apparatus for Automatically Documenting Traffic Light Violations and Protecting Non-violating Drivers," operates, as illustrated in FIG. 1, as a first vehicle (7) is waiting on a "red" traffic signal (3)*a*, on a street (1) (labeled "Third Ave") while traffic progresses through on the intersecting street (2) (labeled "Monroe Street").

When the traffic signal (3)*b* on the intersecting street (Monroe Street) turns "red," signaling "stop," the traffic light state sensor means (5) senses that traffic light (3)*b* is turning red.

The traffic light state sensor means (5), having sensed a red light activates the traffic detection and speed measurement means (4) which registers the presence and velocity of a second vehicle (8) approaching the traffic signal which is changing to red (3)*b* and detects whether the velocity of the second vehicle (8) is at or above a rate predetermined to predict ability and/or propensity to actually stop at the red light (3)*b*. If the traffic detection and speed measurement means (4) determines that the second vehicle (8) has or is going to run the red light (3)*b*, the traffic light delay means (6), to which both sets of traffic signals (3)*a* and (3)*b* and the traffic detection and speed measurement means (4) are in data communication, will withhold switching to "green" traffic light (3)*a*, thereby halting vehicle flow on the adjacent street (1) (Third Ave.) until the vehicle (8) violating the changing traffic signal (3)*b* has safely cleared the intersection.

In this manner, the unsuspecting driver of the first vehicle (7) stopped at the intersection and awaiting signalization to proceed, will not receive a "green" or "go" signal from the governing traffic light (3)*a* until the danger presented by the signal-violating driver (8) has passed.

I claim:

1. An improved method and apparatus for automatically monitoring, regulating and recording disregard of traffic signals comprising:

a) a first set of traffic signalization lights; and b) a second set of traffic signalization lights at a street intersecting the street possessing the first set of traffic signalization lights;

c) a traffic detection and speed measurement means in data communication with the first and second sets of traffic signalization lights;

d) a traffic light state sensor means in data communication with the traffic detection and speed measurement means and the first and second sets of traffic signalization lights; and e) a traffic signal delay means in data communication with the first and second sets of traffic signals, the traffic detection and speed measurement means, and traffic signal state sensor means in order to coordinate the timing of the first and second traffic signalization lights in the event a traffic light violation is detected by the traffic detection and speed measurement means and signal state sensor means.

2. The method and apparatus as described in claim 1 and further an excessive speed detection and recording means which documents the license plate number of violating vehicles when the traffic detection and speed measurement means registers a vehicle running a red light in excess of the maximum posted speed.

3. The method and apparatus as described in claim 1 and further a recording means to document the license plate number of the violating vehicle.

4. The method and apparatus as described in claim 1 or claim 2 and further a means for recording the date, time, and place of the violation simultaneously with recording the license plate number of the violating vehicle.

* * * * *